United States Patent [19]

Shimizu

[11] 4,226,421

[45] Oct. 7, 1980

[54] BRIDGE-LINKING TABLE GAME

[75] Inventor: Takeshi Shimizu, Yashioshi, Japan

[73] Assignee: Kabushikikaisha Anoa, Tokyo, Japan

[21] Appl. No.: 969,326

[22] Filed: Dec. 14, 1978

[30] Foreign Application Priority Data

Aug. 28, 1978 [JP] Japan ..... 53-116686[U]

[51] Int. Cl.[3] ..... A63F 3/00

[52] U.S. Cl. ..... 273/275; 273/282

[58] Field of Search ..... 273/271, 275, 282, 267

[56] References Cited

U.S. PATENT DOCUMENTS

| | | | |
|---|---|---|---|
| 1,709,401 | 4/1929 | Hermann | 273/142 R |
| 3,274,727 | 9/1966 | Zander | 273/282 |
| 3,863,926 | 2/1975 | White et al. | 273/282 |
| 4,047,720 | 9/1977 | Galdal | 273/275 |

FOREIGN PATENT DOCUMENTS

| | | | |
|---|---|---|---|
| 654098 | 12/1962 | Canada | 273/275 |
| 627425 | 8/1949 | United Kingdom | 273/275 |

*Primary Examiner*—Harland S. Skogquist

*Attorney, Agent, or Firm*—Hill, Van Santen, Steadman, Chiara & Simpson

[57] ABSTRACT

A table game set consists of a game board with alternating starting marks and goal marks on each side thereof and with a number of projected islands on the board to receive the pegged ends of playing pieces. The playing pieces are toy bridges resembling several types of bridges, having a length coordinated to span the distances between the islands on the game board. A random indicator operated by the players shows which bridge shaped piece is to be used next as the players take turns placing bridges on the board in an effort to be the first to complete a bridge path spanning corresponding start and goal marks on opposite sides of the board.

3 Claims, 12 Drawing Figures

FIG. 4A
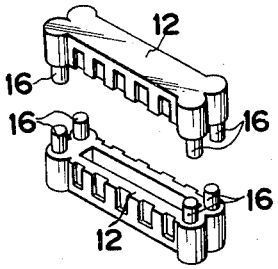
FIG. 4B
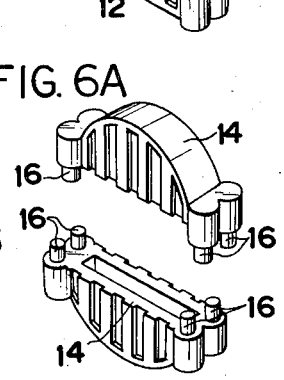
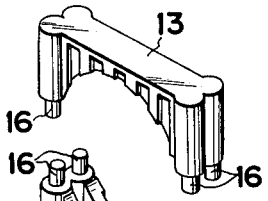
FIG 5A
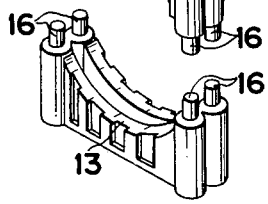
FIG 5B
FIG. 6A
FIG. 6B
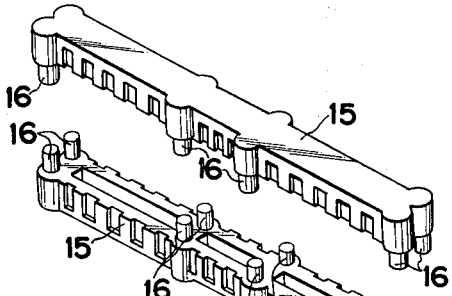
FIG 7A
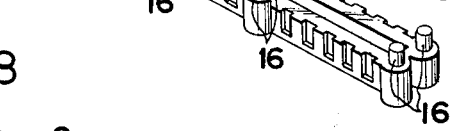
FIG 7B
FIG. 8
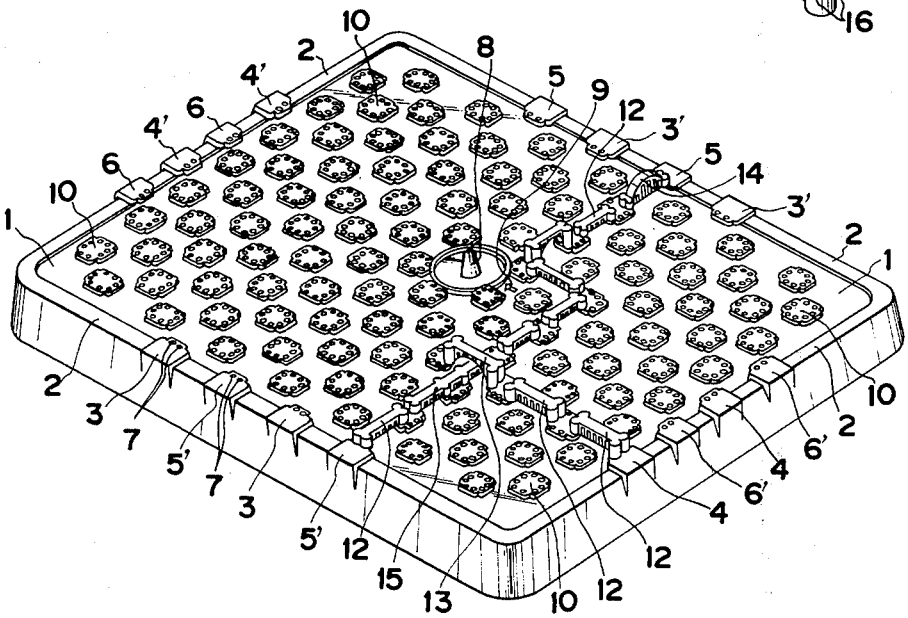

BRIDGE-LINKING TABLE GAME

BACKGROUND OF THE INVENTION

1. Field of the Invention:

This invention relates to a table game set for two to four players.

2. Description of the Prior Art:

Games such as Chinese checkers are known in the art in which the goal of the players is to construct a continuous path from one side of a playing surface to an opposite side. No such table games are known wherein the playing pieces are designed to resemble various types of bridge constructions, and wherein the playing pieces are designed to interact with one another by passing over or under an opposing player's pieces.

SUMMARY OF THE INVENTION

The present invention consists of a game board with several start and goal marks on each side, the start and goal marks on one side corresponding to respective start and goal marks on an opposite side. The board has a plurality of projected islands having holes to receive both ends of pegged playing pieces. Several sets of bridge shaped playing pieces with small pegs on the bottom of the ends of each piece are provided. Each set of pieces contains a multiple of four types of bridges such as wooden, stone, steel and long bridges. A random indicator operated by the players is used to show which bridge shaped piece is to be used next as the players take turns in placing playing pieces on the board in an attempt to be the first to complete a bridge path from a start mark to a corresponding goal mark.

In connecting the bridge shaped pieces from the start to goal marks, players inevitably have to cross another player's path from the start to goal marks. Various rules of play are developed to be used with the game board and pieces to govern such situations. The playing pieces are constructed so that some pieces may pass over or under other pieces. The rules may also designate a priority among the types of bridges, allowing replacement of one's bridge by one's opponent with a bridge of higher priority

BRIEF DESCRIPTION OF THE DRAWINGS

FIGS. 4A, 4B, 5A, 5B, 6A, 6B, 7A and 7B are perspective views of four types of playing pieces.

FIG. 8 is a perspective view of the game board in use during the course of play.

DESCRIPTION OF THE PREFERRED EMBODIMENTS

Figure 1:
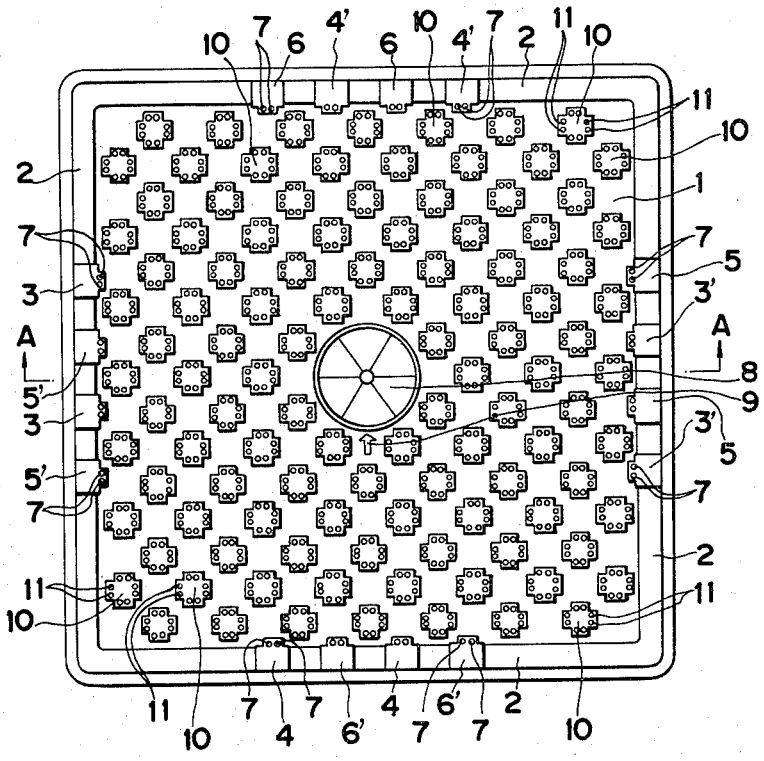
FIG. 1 is a plan view of the game board.
Figure 2:
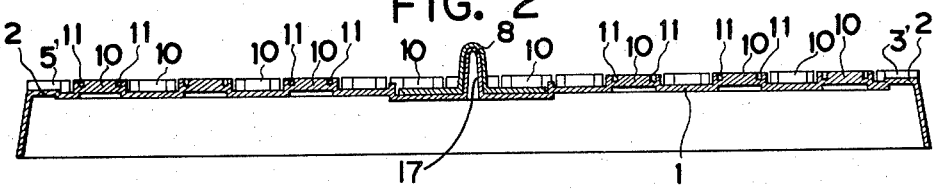
FIG. 2 is a sectional view taken on line A-13 A of FIG. 1.
Figure 3:
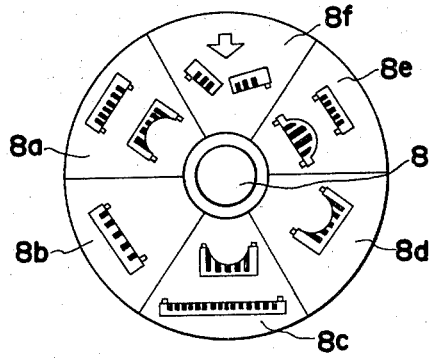
FIG. 3 is an enlarged plan view of the playing piece indicator.

A game board 1 is shown in FIG. 1. A frame 2 borders the periphery of the game board 1. On each side of the frame 2, there are two start marks such as marks 3, 4, 5 and 6, and two goal marks such as marks 3', 4', 5', and 6' corresponding to start marks on respective opposite sides. Corresponding sets of start and goal marks may be so designated by having the same color and different corresponding sets have different colors. Although the game board 1 is shown in the drawings as a square, it will be understood that the board may be of any shape as long as a playing area having opposite sides may be disposed thereon. Two small holes 7 are disposed near an inner side of each start or goal mark nearest the playing area.

A spinner 8 is provided as a playing piece indicator in the center of the game board 1. The spinner 8 rests on a pylon 17 projecting from the game board 1 such that it may be rotated about the vertical axis of the pylon 17. It is preferable that the amount of friction between the spinner 8 and the pylon 17 is such as to allow the spinner 8 to complete several revolutions after a rotational movement is imparted by a player. The spinner 8 is divided into six equal sections **8*a* through 8*e* indicating the use of a different type of playing piece or pieces. Section 8*f* has a different significance as explained below. An arrow 9 on the game board 1 indicates a section of the spinner 8 when it has stopped after revolution according to which a player uses a playing piece. There are a plurality of projected islands 10 on the game board 1 inside the frame 2. On the sides of each projected island 10 there are four pairs of small holes 11 disposed along lines forming a square. The distance between the holes 11 in each pair on every island 10 is the same as that between the holes 7** on the start and goal marks.

There are four types of playing pieces having different shapes resembling different types of bridge constructions. A playing piece 12, shown in FIGS. 4A and 4B, resembling a wooden bridge has a generally rectangular parallelpiped shape. A playing piece 13 resembling a stone bridge is shown in FIGS. 5A and 5B and is generally in the shape of an arch having a flat top. The arch is of sufficient height to pass over a wooden bridge piece 12 or a long bridge 15. A playing piece 14, shown in FIGS. 6A and 6B, resembles a steel truss bridge having a flat bottom and a semi-circular arc shaped top. A playing piece 15 shown in FIGS. 7A and 7B is in the shape of two wooden bridges 12 connected together end-to-end. Each playing piece has two pegs 16 projecting downwardly from each end. Each long bridge piece has such pegs 16 at both ends and two additional pairs of pegs 16 disposed at equal distances from its midpoint. The distance between the pegs 16 at both ends of pieces 12, 13 and 14, and that between the pegs 16 at the end and center of a long bridge piece 15, are the same as that between the holes 11 in adjacent projected islands 10, and also as that between the small holes 7 on the start marks 3, 4, 5 and 6 and goal marks 3', 4', 5' and 6' and the small holes 11 on a projected island 10 facing the respective marks. The diameters of a peg 16 and that of a hole 11 are such that a peg 16 fits into a hole 11. When so fitted, the playing pieces 12, 13 and 14 span the gap between a start or goal mark and an adjacent island, or the gap between any two adjacent islands. The long bridge 15 spans a total of two such gaps.

Four sets of playing pieces are provided, one for each player. A suggested composition of each set is: fifteen wooden bridge pieces 12, ten stone bridge pieces 13, two steel bridges 14 and two long bridges 15. Other compositions may also be suitable, although it is suggested that the number of long bridge pieces 15 be low because of their advantage in spanning two gaps at once. Each set may be color coded to correspond to the colors of the respective start and goal marks. The playing pieces 12, 13, 14 and 15, the game board 1, and the spinner 8 may all be made of molded plastic or other suitable material.

The game board 1, playing pieces 12, 13, 14 and 15, and the spinner 8 may be used as follows. A priority is assigned to the playing pieces with steel bridge pieces 14 having highest priority, stone bridge pieces 13 having next highest priority, and wooden bridge pieces 12 and long bridge pieces 15 having equal and lowest priority. The priority is arbitrary, but it is suggested that priority be inversely proportional to the number of each type of playing piece in a set, with the exception of the long bridge pieces 15.

In playing a game using the invention, each player receives a set of playing pieces and has the goal of placing the playing pieces between projected islands so as to be the first to connect his or her start mark to the corresponding goal mark, beginning at one of the start marks, for instance, at start mark 5 as shown in FIG. 8. Play is governed by a spin of the spinner 8 by each player in sequence until a winner occurs. The types of playing pieces are designated on the spinner 8 in the sections 8*a* through 8*e* thereon. When the spinner 8 comes to a rest, the playing piece designated by the segment of the spinner 8 nearest the arrow 9 on the game board 1 can be placed on the board by the player. Some segments of the spinner 8 such as 8*a*, 8*c* and 8*e* designate two types of playing pieces which may be played, and the player may choose whichever type of playing piece is the most advantageous in a given situation.

Because opposing players are attempting to cross the game board 1 in generally perpendicular paths, it is inevitable that one player's bridge path may block an opposing player's path. If the blocking playing piece is a wooden bridge piece 12 or a long bridge piece 15, a stone bridge piece 13 may be placed over the blocking piece. This may be done, however, only when the player spins section 8*a* or section 8*d*. Alternatively, if a player spins section 8*f*, he or she may replace the blocking bridge piece with a piece of his own choosing which has an equal or higher priority than the blocking piece. Thus a steel bridge piece 14 may replace, when the spinner 8 indicates section 8*f*, an opposing player's wooden bridge piece 12, stone bridge piece 13 or steel bridge piece 14 already in a position blocking the way. A stone bridge piece 13 may be placed over a wooden bridge piece 12 or a long bridge piece 15, or, when the spinner 8 indicates section 8*f*, it may replace an opposing player's stone bridge piece 13 already in a position blocking the way or another player's wooden bridge piece 12 meeting the stone bridge piece 13 end-to-end. A long bridge piece 15 may be placed under a stone bridge piece 13, and, when the spinner 8 indicates section 8*f*, it may replace another player's wooden bridge piece 12 already in position blocking the way.

It will be understood that means other than holes and pegs may be employed to maintain the playing pieces in position on the game board 1. For example, magnets and magnetically attractive material may be disposed on the bridges and islands respectively, or the islands may have grooves disposed on each side thereof capable of receiving an end of a bridge. Also, an indicator governing play other than the spinner 8 may be employed, such as a die having the designations appearing on segments 8*a* through 8*f* on its faces. Although various other minor modifications may be suggested by those versed in the art, it should be understood that I wish to embody within the scope of the patent warranted hereon all such embodiments as reasonably and properly come within the scope of my contribution to the art.

I claim as my invention:

1. A table game comprising:

a game board having a four sided playing area, said playing area surrounded by a frame;

a plurality of start marks mounted on each side of the frame, each said start mark having a pair of holes disposed therein;

a plurality of goal marks mounted on each side of the frame, each of the goal marks corresponding to a start mark with corresponding goal and start marks mounted in alignment on opposite sides of the frame, and each said goal mark having a pair of holes disposed therein;

a plurality of islands each having a center, mounted in rows on the base inside the frame, with said centers aligned and said centers spaced equal distances apart, each said island having four pairs of holes disposed therin, each said pair of holes disposed on a side of a square having a center coincident with the center of the island, such that a fixed distance between two adjacent pairs of holes disposed on any adjacent islands is the same, a plurality which is less than all of said rows including and in alignment with corresponding goal and start marks, said islands in said plurality of rows being disposed inside said frame such that a distance from a pair of holes on any start mark or goal mark to an adjacent pair of holes on an adjacent island in a same row as said start mark or goal is equal to said fixed distance;

a plurality of playing pieces each having a length such that said playing pieces may be placed to connect adjacent islands in a same row and to connect a goal mark or a start mark to an adjacent island, each said playing piece having a bottom from which four spaced pegs extend downwardly, said pegs being of a diameter receivable by said holes in said islands and said start and goal marks, said pegs disposed on said pieces such that each playing piece may be placed in said holes to connect adjacent islands or an island and an adjacent start mark or goal mark by at least one fixed distance, said playing pieces comprised of a plurality of different types;

an upwardly extending pylon integrally mounted at a center of said game board;

a disc rotatably mounted on said pylon, said disc having sectors marked thereon designating different playing piece types and a mode of play; and a marker on said game board adjacent said disc to indicate a particular disc sector after said disc is rotated by a player.

2. The table game of claim 1 wherein said plurality of playing pieces is comprised of the following types:

a plurality of wooden bridge pieces having a flat top and a flat bottom;

a plurality of stone bridge pieces having a flat top and an arched bottom;

a plurality of steel bridge pieces having a flat bottom and an arched top, said wooden bridge pieces, said stone bridge pieces, and said steel bridge pieces each having a length such that each piece may span one said fixed distance;

a long bridge piece having a flat top and a flat bottom and a length such that said long bridge piece may span two said fixed distances.

3. The table of claim 2 wherein said plurality of playing pieces comprises:

fifteen wooden bridge pieces;
ten stone bridge pieces;
two steel bridge pieces; and
two long bridge pieces.

* * * * *

UNITED STATES PATENT AND TRADEMARK OFFICE

CERTIFICATE OF CORRECTION

PATENT NO. : 4,226,421

DATED : October 7, 1980

INVENTOR(S) : Takeshi Shimizu

It is certified that error appears in the above—identified patent and that said Letters Patent is hereby corrected as shown below:

In column 1, line 47, cancel "A-13A" and substitute -- A-A -- therefor.

In column 4, line 18, cancel "therin" and substitute -- therein -- therefor.

In column 6, line 1, insert -- game of -- following "table".

Signed and Sealed this

*Fourth* Day of *August 1981*

[SEAL]

*Attest:*

GERALD J. MOSSINGHOFF

*Attesting Officer*

*Commissioner of Patents and Trademarks*